United States Patent [19]

Justiano et al.

[11] Patent Number: 4,722,136

[45] Date of Patent: Feb. 2, 1988

[54] SNAP-IN CONVENIENCE ELECTRICAL CONNECTOR SYSTEM AND METHOD OF ASSEMBLY

[75] Inventors: Joseph G. Justiano, Bethpage; Wolfgang F. Bienwald, Melville, both of N.Y.

[73] Assignee: Leviton Manufacturing Company, Inc., Little Neck, N.Y.

[21] Appl. No.: 790,663

[22] Filed: Oct. 28, 1985

[51] Int. Cl.[4] ..... H01R 13/74

[52] U.S. Cl. ..... 29/837; 248/27.3; 439/557

[58] Field of Search ..... 339/128, 154 A; 248/27.3; 29/837; 435/549, 552, 557

[56] References Cited

U.S. PATENT DOCUMENTS 2,239,451 4/1941 Stearns ..... 339/128 X 3,137,448 6/1964 Holzhause ..... 339/154 A X

*Primary Examiner*—Eugene F. Desmond

*Attorney, Agent, or Firm*—Paul J. Sutton

[57] ABSTRACT

A convenience electrical connector that is snap-mounted to a wall panel. The body portion forms a body planar surface that is adapted to grip the inner wall of the panel. A cover secures the inner side of the body member. A pair of opposed biasable arms connected to the cover extend through side recesses to a position where keeper planar walls at the ends of the arms are positioned to grip the outer wall of the panel after being biased inwardly along keeper ramps by opposed edges of the panel opening. The connector comprises two units, the body and the cover with the two connected arms. Mounting is accomplished by inserting the arms into recesses and pressing the two units together. A pair of snap-in flanges at the ends of the cover are biased outwardly by clamped lock members at the side walls of the body portion and then self-biased into a locking mode with the body portion.

2 Claims, 9 Drawing Figures

FIG. 1
PRIOR ART
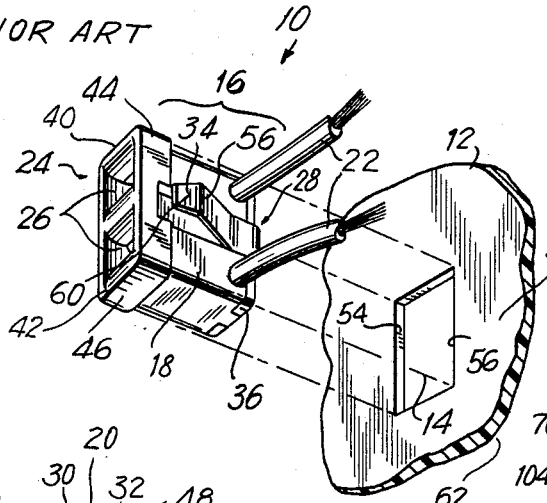
FIG. 2
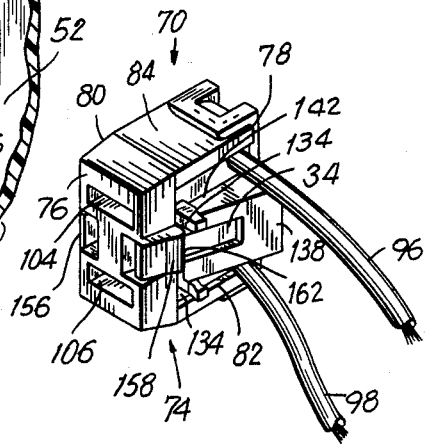
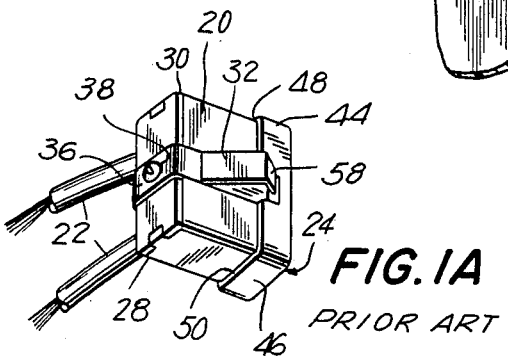
FIG. 1A
PRIOR ART
FIG. 3
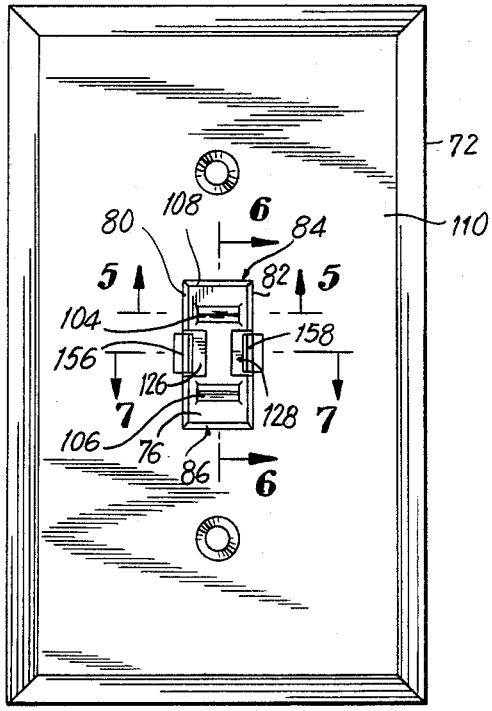

70
72
74
76
78
80
82
84
88
90
92
94
96
98
100
104
106
108
110
112
114
118
120
122
124
126
128
132
136
138
140
142
144
146
148
150
152
154
156
158
160
162
164
166
168
170
172
174
176
178
180
182
184
186
188

SNAP-IN CONVENIENCE ELECTRICAL CONNECTOR SYSTEM AND METHOD OF ASSEMBLY

BACKGROUND OF THE INVENTION

This invention relates generally to a convenience electrical outlet and more particularly to a convenience outlet that is snap-mounted to a wall panel.

Snap in convenience outlets, which include prong receptacles, electrical contacts, and electrical leads to a source of electrical power, are typified by Leviton catalogs snap-on convenience outlets nos. 298 and 1306, which include a plastic body forming the receptacles and holding the contacts and leads, a back cover holding the contacts and leads in the body, a pair of biasable snap-in connectors, and a screw for securing the cover and the connectors to the back of the body. The connector includes four elements exclusive of the contacts and leads.

The primary problem of the prior art is that of assembling three elements besides the contacts and leads and screw mounting the three elements together to complete the assembly.

The present invention overcomes the limitations and disadvantages of the prior art by providing a snap-in electrical connector system that greatly increases the efficiency of assembly of a snap-in connector.

It is also noted that the prior art mentioned, which is shown in FIGS. 1 and 1A, is mounted to the panel from the outside so that the leads must be tucked into the panel opening. Also, because the snap-in arm elements have no set planar gripping arm, the bias of the arm elements must be very strong, thus causing a special exertion upon mounting the connector to the panel. Connections of this type are adapted to fit wall panels of various thicknesses, so that no planar gripping surface is provided on the inner side of the panel.

Accordingly, it is an object of this invention to provide a snap-on electrical connector system that includes only two mounting elements.

It is another object of this invention to provide a snap-in connector system that includes two mounting elements that are quickly and simply assembled along with the contacts and leads.

It is yet another object of this invention to provide a snap-in connector system that includes two elements that are quickly assembled together with the contacts and leads by a snap-in technique.

It is still another object of this invention to set forth a method of assembling a snap-in connector apparatus that provides for easily and quickly snapping in a hold-down and snap-in element into a connector body while securing the contacts and leads to the body in one basic step.

It is another object of the present invention to provide a snap-in connector system that provides planar gripping surfaces for gripping both the inner and outer surfaces of the wall panel.

The present invention fulfills the above objects and overcomes the limitations and disadvantages of prior art by providing a snap-in convenience electrical connector system for mounting to a wall panel, that includes a body member forming a pair of passages holding electrical contacts and leads and for receiving the prongs of a plug. The body member has outer and inner sides relative to outer and inner sides of the wall panel. The inner side of the body member is covered with a cover element that has a pair of elongated, biasable arm elements that are adapted to be positioned in a pair of recesses formed by the body along its side walls. The arm elements are biased against outer ramped walls of the recesses as they are mounted to the body members with the cover element. The outer elements include keeper portions having planar surface that are adapted to grip the outer surface of the panel after the system is snap-mounted onto the panel through the panel opening. The snap-on connection is accomplished by opposed edges of the panel opening pressing the keeper portions of the arm elements inwardly so that the arm elements are moved to almost a fully biased mode. Once the planar surfaces of the keeper elements pass the outer surface of the panel, the arm elements snap the keeper portions outwardly so as to slide the planar surfaces of the keeper portions over the outer surface of the panel. The ramped outer wall of the recess forms a body planar surface that is adapted to be pressed against the inner surface of the panel where the keeper portions of the arm elements snap over the outer surface of the panel. Thus, the panel is gripped on both its inner and outer surfaces by opposed planar surfaces.

The mounting of the cover element with the attached arm elements is accomplished in one movement by sliding in the arm element into the side recesses of the body member and pressing the cover element down against the inner side of the body member.

A pair of opposed flanges connected to the end edges of the cover element extend along the end walls of the body element. The flanges form holes that accept lock elements that extend from the end walls of the body elements. The lock elements are ramped so as to bias the flanges outwardly during mounting until planar edges of the lock elements pass a locking bar of the flanges and the lock elements enter the flange holes and the flanges are self-biased inwardly to the end walls of the body member.

The flange and lock members act as locks to secure the cover element to the inner side of the body member and to maintain the planar walls of the keeper portions of the arm elements at a particular distance outwardly from the planar gripping surfaces of the body member so that the selected panel of the desired thickness will be accepted between the keeper surface of the arm elements and the gripping surfaces of the body member.

Assembly of the invention is essentially accomplished in two steps, that is, first, placing the cover member end the connected arm elements into position at the inner side of the body member, and second, bringing the body member and the cover elements with arm elements together with enough pressure to snap the flange to the cover element over the snap members of the body member and to pass the arm elements from the ramped recesses, or chutes, of the body member in increasing biasing pressure until the biasing pressure is relieved by self-biasing action of the arm elements outwardly at their position for mounting to the wall panel.

My invention will be more clearly understood from the following description of a specific embodiment of the invention together with the accompanying drawings:

FIG. 1 is a perspective view of a prior art embodiment;

FIG. 1A is another perspective view of the prior art embodiment shown in FIG. 1;

FIG. 2 is a perspective view of the invention;

FIG. 3 is a front view of the invention snapped in a wall plate;

Reference is now made in detail to the drawings wherein similar reference characters denote similar elements throughout the several views.

Figures 4, 5, 5A:
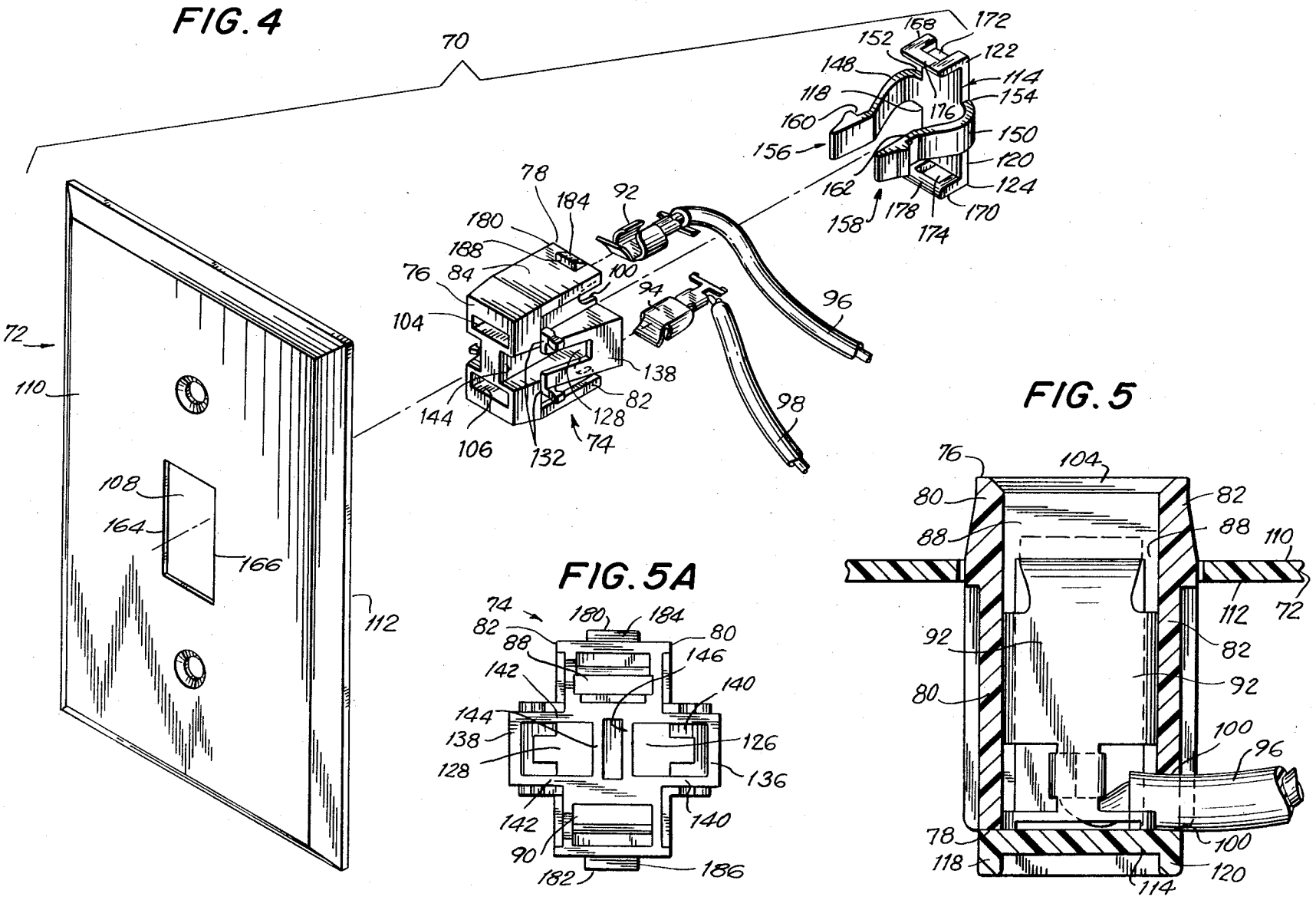
FIG. 4 is an exploded perspective view of the invention together with a wall plate and electrical contacts and leads.
FIG. 5 is a sectional view taken through lines 5—5 of FIG. 3.
FIG. 5A is rear view of the body member.

Before proceeding to a description of this invention, a brief description will be made of the prior art snap-in electrical connector 10 shown in perspective view in FIG. 1 and 1A being mounted to a wall panel 12 in FIG. 1. Panel 12 forms a panel opening 14 adapted to receive the rectangular profile of connector 10. Connector 10 includes a body member 16 having side walls 18 and 20, body member 16 forming a pair of passages for holding electrical contacts (not shown) connected to a pair of electrical leads 22 that extend through holes in side wall 18 of body member 10 for connections to a source of electrical power. Body member 16 includes an outer side 24 where a pair of apertures 26 leading to the contacts in the passage are located, apertures 26 being adapted to receive the prongs of a plug. Body member 16 includes an inner side 28 that is to be positioned inside panel 12 and the wall to which panel 12 is mounted. A cover element 30 extends over inner side 28 so as to capture the electrical contacts and leads 18 in the passages and generally to body member 16.

An elongated pair of biasable arm elements 32 and 34 extend along side walls 18 and 20 to a position spaced from outer side 24. A pair of recesses in side walls 18 and 20 allow for inward movement of arm elements 32 and 34. A center portion 36 joins arm element 32 and 34 across inner side 28 over cover element 30. A screw 38 connects arm elements 32 and 34 at portion 36 and cover element 30 to the center of inner side 28 of body member 16. Body member 16 includes end walls 40 and 42 at the outer side 24 of which extend a pair of flange 44 and 46 forming planar gripping surfaces 48 and 50. Connector 10 is moved into panel opening 14 towards the outer surface 52 of panel 12 so that biased arm elements 32 and 34, which are winged outwardly from side walls 18 and 20, are pressed inwardly towards body member 16 by opposed edges 54 and 56 of panel opening 14. Upon assembly, planar gripping surfaces 48 and 50 are positioned against outer surface 52 of panel 12 and ramped portions 58 and 60 of arm elements 32 and 34 are wedged against edges 54 and 56 from the inner surface 62 of panel 12. Ramped portions 58 and 60 adjust themselves by self-biasing outward pressure to various thicknesses of panel 12, that is, the distance between outer surface 52 and inner surface 62. Grooves are formed in ramped portions 58 and 60 to aid in adjusting arm elements 32 and 34 to various thickness of panel 12.

The invention herein will now be described. A snap-in convenience electrical connector system 70 is shown in isolated perspective view in FIG. 2, in frontal view in FIG. 3 mounted to a panel 72, which is set into a wall, and in exploded perspective in FIG. 4.

Figure 7:
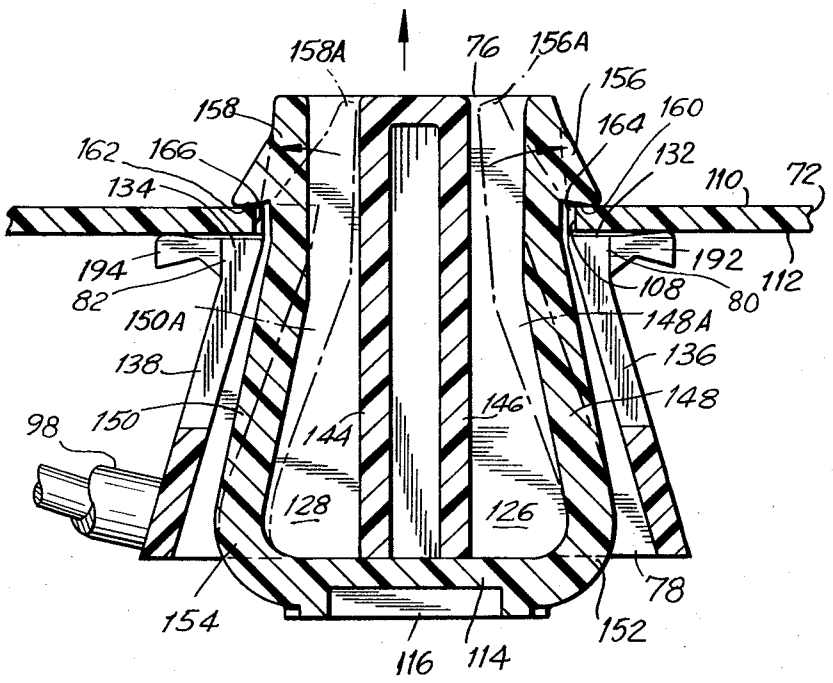
FIG. 7 is a sectional view taken through line 7—7 of FIG. 3.
Figure 6:
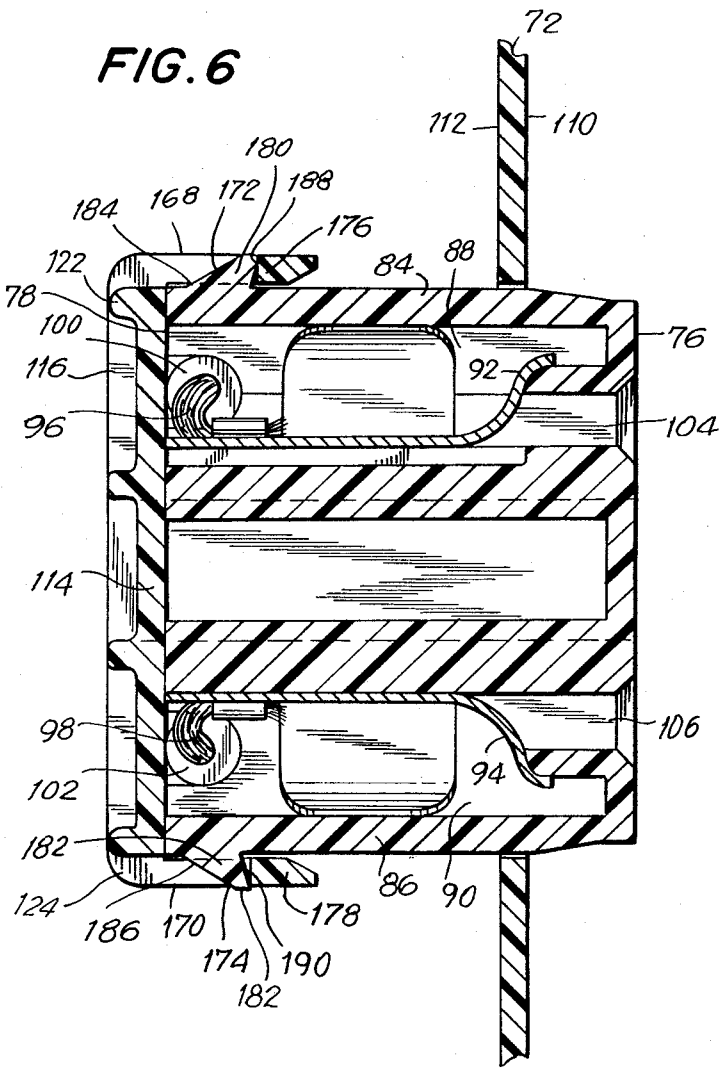
FIG. 6 is a sectional view taken through lines 6—6 of FIG. 3.

Connector system 70 includes a body member 74, seen best in FIGS. 2 and 4, which has opposed outer and inner sides 76 and 78, at the front and back ends respectively, of the body member, a pair of opposed side walls 80 and 82, and a pair of opposed end walls 84 and 86, the side and end walls extending between opposed outer and inner sides 76 and 78. Body member 74 forms a pair of spaced, generally parallel passages 88 and 90 extending between inner and outer sides 76 and 78. Passages 88 and 90 are located proximate to end walls 84 and 86 and also to side walls 80 and 82. Passages 88 and 90, seen best in FIGS. 5, 6, and 7, are adapted to hold a pair of electrical contacts 92 and 94, respectively, connected to a pair of electrical leads 96 and 98, respectively, that extend beyond body member 74 through a pair of openings 100 and 102 formed by side wall 82 at inner side 78. It is within the state of the art to have clip-on terminals, pin jacks, or other substitutes for leads 96 and 98 through openings 100 and 102. Leads 96 and 98 are connected to a source of electrical power. Apertures 104 and 106 at outer side 76 of body member 74 leading to passages 88 and 90, respectively, are adapted to receive a pair of prongs of a plug (not shown). Body member 74 is adapted to be positioned in panel opening 108.

Panel 72 has opposed outer and inner surfaces 110 and 112, respectively. Outer side 76 of body member 74 is associated with panel outer surface 110 in the mounted position, while inner side 78 extends past inner surface 112, and in the normal situation is hidden behind the wall, as at inner surface 112 of panel 72.

An elongated cover element 114, preferably a substantially flat wall as seen best in FIGS. 4–7, with molded indentations 116 that open inwardly away from body member 74, has opposed cover end edges 122 and 124 that connect with opposed cover side edges 118 and 120. Cover element 114 is positioned over inner side 76 of body member 74 so that cover side edges 118 and 120 are generally aligned with body side walls 80 and 82, respectively; and cover end edges 122 and 124 are generally aligned with body and walls 84 and 86, respectively. Cover element 114 is adapted to hold down leads 96 and 98 with contacts 92 and 94 in passages 88 and 90, which open to inner side 78. Cover element also covers holes 100 and 102 open to inner side 78.

Body member 74 forms a pair of opposed recesses 126 and 128 between passages 88 and 90 and extending generally parallel with body side walls 80 and 82, respectively, from body inner side 78 to gripping planar surfaces 132 and 134 formed at the front end of outer walls 136 and 138, respectively, that define in part recesses 126 and 128, respectively. Pairs of opposed end walls 140 and 142 for recess 126 and 128 respectively join recess outer walls 136 and 138, respectively, to body side walls 80 and 82, respectively. Recesses 126 and 128 are further defined by recess inner walls 146 and 144, respectively, which are generally opposed to recess outer walls 136 and 138, respectively, and are spaced inwardly from body side walls 80 and 82, respectively. Gripping planar surfaces 132 and 134 extend tranversely from body side walls 80 and 82, and are spaced inwardly from body outer side 76. The gripping planar surfaces are adapted to be positioned in gripping association with panel inner surface 112.

As seen best in FIG. 4, but also in FIGS. 2, 3, and 7, are a pair of opposed, elongated, biasable arm elements 148 and 150 having opposed connected ends 152 and 154, respectively, and free ends having ramped keeper portions 156 and 158, respectively, which are angled away from arm elements 152 and 154, or outwardly relative to body member 74. When assembled, with cover element 114 on the inner side back end of the body, and arm elements 148 and 150 in receses 126 and 128 respectively, keeper planar surfaces 160 and 162, respectively are generally opposed to gripping planar surfaces 132 and 134 respectively, at a keeper position spaced nearer to body outer side 76 than and gripping planar edges 132 and 134. Keeper planar surfaces 160 and 162 are adapted to be positioned in gripping association with panel outer surface 110 preferably directly opposed to gripping planar surfaces 132 and 134 which are at the back of the panel when the body with cover element is installed on the body.

Panel opening 108 is defined in part by at least one pair of opposed panel edges 164 and 166. Recesses 126 and 128 are adapted to allow movement of arm element 148 and 150 between first and second positions as shown best in FIG. 7. In particular, recess inner walls 144 and 146 opposite recess outer walls 138 and 136 are sufficiently spaced from one another to allow inward movement of arm element 150 and 148 to a substantially fully biased mode. In the first position, arm elements 148 and 150 are in a partly biased mode and press outwardly from body member 74 against recess outer walls 136 and 138, respectively. In the second position, arm elements 148 and 150 are pressed inwardly toward body member 74 away from recess outer walls 136 and 138 to a substantially fully biased mode greater than the previous partly biased mode of the first position and shown in FIG. 7 as arm elements 148A and 150 A and keeper portions 156A and 158A. Keeper portions 156 and 158 are adapted to be moved from the first position to the second position by panel edges 164 and 166 during mounting of system 10 to panel 72, which is accomplished by entering system 10 from the inner surface side 112 towards the outer surface side 110. Arm members 148 and 150 are self-biased from the second position back to the first position upon keeper planar surfaces 160 and 162 having been moved past panel outer surface 110.

Recess outer walls 136 and 138 are ramped from an extended ramping position at body inner side 78 to gripping planar surfaces 132 and 134. Ramped outer walls 136 and 138 are adapted to allow recesses 126 and 128 to receive arm elements 148 and 150 in an unbiased mode during assembly of cover element 114 with body member 74. Ramped outer walls 136 and 138 are further adapted to press keeper portions 156 and 158 together towards body member 74 so as to move arm elements 148 and 150 to a substantially fully biased mode before attaining the deeper position where arm elements 126 and 128 are self-biased to a partly biased mode of the first arm position whereby system 10 is ready for mounting to panel 72.

Cover element 114 is secured, or locked, tightly across body inner side 78 and keeper portions 156 and 158 with arm elements 148 and 150 secured at a position wherein keeper planar surfaces 160 and 162 are kept at a selected distance from gripping planar surfaces 132 and 134. Panel 72 has a thickness measured between panel outer and inner surfaces 110 and 112 that is substantially equal to the distance between keeper planar surfaces 160 and 162 and gripping planar surfaces 132 and 134, with the understanding that panel 72 will be positioned in a gripped mode between keeper planar surfaces 160 and 162 and gripping planar surfaces 132 and 134. This securing is accomplished by a pair of opposed flanges 168 and 170 connected to cover element 114 at cover and edge 122 and 124, respectively, and extending along body end walls 84 and 86, respectively. Flanges 168 and 170 form respective flange holes 172 and 174, which are preferably rectangular, and which are defined in part by respective locking bars 176 and 178 which extend lateral to body end walls 84 and 86. Locking bars 176 and 178 are shown as the end portions of flanges 168 and 170. A pair of lock elements 180 and 182 extend from body end walls 84 and 86 and are, in the assembled position, located in flange holes 172 and 174, respectively. Locking bars 176 and 178 are adapted to lock flanges 168 and 170 with body end walls 84 and 86, cover element 114 against body inner side 78, and keeper portions 160 and 162 at the selected keeper position.

Flanges 168 and 170 are capable of being moved between first and second flange positions. Lock elements 180 and 182 include ramped walls 184 and 186, respectively, which are capable of biasing flanges 168 and 170 from the first flange position to the second flange position during assembly of cover element 114 with body member 74. Lock element 180 and 182 further include lock planar walls 188 and 190 spaced from body inner side 78 and transverse to body end walls 84 and 86. In the first flange position, flanges 168 and 170 are in an unbiased mode; and in the second flange position, flanges 168 and 170 are in a biased mode. When cover element 114 and body members 72 are unassembled, flanges 168 and 170 are in the first unbiased position. During assembly of cover element 114 with body member 72, ramped walls 184 and 186 bias flanges 168 and 176 to the second biased flange position until lock elements 180 and 182 enter flange holes 172 and 174 and locking bars 176 and 178 are positioned at lock planar walls 188 and 190, whereupon flange 168 and 170 are self-biased back to the first unbiased flange position and cover element 72 with arm elements 148 and 150 are assembled ready for first assembly with panel 74.

Pairs of positioning fingers 192 and 194 extend generally normal from the body side walls 80 and 82, respectively, on opposed sides of recesses 126 and 128 aligned with gripping planar surfaces 132 and 134, so that fingers 192 and 194 are in gripping contact with panel inner surface 112 upon assembly of system 10 along with gripping planar surfaces 132 and 134.

The method of assembling snap-in connector 10 comprises the following steps:

(a) positioning a pair of electrical contacts connected to a pair of electrical leads into a pair of parallel passages formed in a body member, including positioning a portion of each electrical lead at an opening formed in a side wall of the body member at the inner side of the body member; and (b) assembling a unitary cover and gripping member to the body member as follows:

(1) inserting a pair of elongated, biasable arm elements connected to the unitary member into a pair of recesses having ramped walls formed by the body member, the arm elements being inserted at the inner side of the body member;

pressing the unitary member at a cover portion to the open inner side of the body member thus forcing the arm elements farther into the pair of ramped recesses, so as to cause the arm elements to press towards one another by the ramped walls of the recesses from an unbiased mode to a biased mode; and simultaneously, pressing outwardly a pair of end flanges connected to the ends of the cover of the unitary member into a biased mode by way of a pair of ramped walls on the body member; and continuing to press the cover portion until it is in contact with the inner side of the body member, thus positioning the unitary cover and gripping member both for the release of the arm elements from a generally fully biased mode to a partly biased mode when the keeper portions reach stop surfaces at the ends of the ramp walls, and for a release of the end flanges from a biased mode to less biased mode when holes in the flanges receive lock elements extending from the end walls of the cover element, thus achieving the assembly of the gripping member with the body member as a snap-in connector.

The method further includes the step of pressing the assembled convenience connector into a panel opening formed by a wall panel, from the inner surface side of the panel, with the outer side of the body member having female apertures for the plug prongs entering first until, (a) forward facing gripping planar surfaces extending transversely from the body side walls, and spaced inwardly from the body outer side, are in gripping association with the panel inner surface; and (b) the free ends of the biasable arm elements having rearward facing keeper planar surfaces, and keeper portions ramped away from the arm elements, are biased inwardly by the opposed edges of the panel opening by the ramps until they pass through the panel opening whereby an amount of inward bias is relieved, and the keeper planar surfaces reach the outer surfaces of the panel wall about simultaneously with the gripping planar surfaces of the body side reaching the inner surface side of the panel.

It is noted that the thickness of wall panel 72 is to be determined prior to the step of pressing assembled connector 10 to panel 72. Therefore, prior to the step of placing assembled connector 10 with panel 12 there is also included the step of selecting a panel having a wall thickness approximately equal to the distance between the keeper planar surfaces of the arm elements and the gripping planar surface of the body member.

The embodiment of the present invention particularly disclosed herein is presented merely as example of the invention. Other embodiments, forms, modifications and variations of the embodiments of this invention set forth here, coming within the proper scope of the appended claims, will of course readily suggest themselves to those skilled in the art.

What is claimed is:

1. A method of assembling a snap-in convenience electrical connector system for mounting in a panel, comprising the following steps:

(1) inserting an electrical contact in each of two passages formed in a body of said connector running between the front and the back of the connector, through an opening in each passage at the back of the connector, (2) assembling a unitary cover and gripping member to the body member as follows;

(a) inserting a pair of elongated, biasable arms which are connected to the unitary member, into a pair of ramped recesses formed by the body, so that the unconnected ends of the arms are toward the front of the body, and the unitary member is at the back of the body, (b) pressing the unitary member toward the back of the body, so that the arms are forced further into the pair of ramped recesses and are pressed towards one another by ramped walls of the recesses, moving the arms from an unbiased mode to a biased mode; and so that a pair of end flanges connected to the unitary member are forced into a biased mode by a ramped surfaces between the flange and the body; and (c) continuing to press the unitary member until it is in contact with the back of the body whereby the ramping engagement is passed and arms are released to a less biased mode, and the unitary member blocks the passage openings, preventing escape of the contacts by way of the openings.

2. A method according to claim 1, further comprising the step of pressing the assembled convenience connector into a panel opening from the inner surface side of the panel with the front of the connector foremost until ramped portions of the free ends of the biasable arm elements are biased inwardly by opposed edges of the panel opening, and continuing to press until the ramped portions pass the edges and the biasable arm elements move outwardly and engage the outer surface side of the panel while extensions on the body simultaneously engage the inner surface side of the panel, for securing the connector in the panel.

* * * * *